United States Patent [19]

Rufer

[11] Patent Number: 4,752,138

[45] Date of Patent: Jun. 21, 1988

[54] DEVICE FOR STIRRING OR PUMPING

[76] Inventor: Dieter A. Rufer, Postfach 1426, Wolfisbuehl, CH-6020 Emmenbruecke, Switzerland

[21] Appl. No.: 834,325

[22] PCT Filed: Apr. 30, 1985

[86] PCT No.: PCT/CH85/00067

§ 371 Date: Feb. 7, 1986

§ 102(e) Date: Feb. 7, 1986

[87] PCT Pub. No.: WO85/05046

PCT Pub. Date: Nov. 21, 1985

[30] Foreign Application Priority Data

May 7, 1984 [CH] Switzerland ..... 2204/84

[51] Int. Cl.[4] ..... B01F 13/08

[52] U.S. Cl. ..... 366/274; 366/273; 366/601

[58] Field of Search ..... 366/273, 274, 279, 342, 366/343, 144–146, 149, 601; 310/40 R, 43, 46

[56] References Cited

U.S. PATENT DOCUMENTS 1,242,493 10/1917 Stringham ..... 366/274
4,131,370 12/1978 Lawrence et al. ..... 366/273
4,529,900 7/1985 Uzuka .

FOREIGN PATENT DOCUMENTS 634234 8/1936 Fed. Rep. of Germany ..... 366/273
3106175 9/1982 Fed. Rep. of Germany ..... 366/273
919723 4/1982 U.S.S.R. ..... 366/273

OTHER PUBLICATIONS

Williams, A. R., "An Electromagnet Modification of the Zimm-Crothers Viscometer", Journal of Scientific Instruments (Journal of Physics E), Mar. 1969.

*Primary Examiner*—Timothy F. Simone
*Attorney, Agent, or Firm*—Thomas W. Speckman; Ann W. Speckman

[57] ABSTRACT

A magnetic rotor (3) of suitable configuration is supported so that it is free to rotate in a vessel or tube, whereby the rotor is in direct contact with the stirred or pumped medium and is rotated by the rotary magnetic field of an electromagnetic drive system (2). The rotary magnetic field is generated by a number of coil segments (6,6',6'',6''') controlled by phase-shifted alternating currents (8,8'), whereby the coil segments are arranged on an annular core (4) of ferromagnetic material. With the appropriate arrangement and control of the coil segments, the rotor located near the ring axis turns very smoothly, since the presence of individual magnetic poles can be dispensed with. The annular design of the core also allows stirring to be performed in a vessel with a central outlet at the bottom. The electromagnetic drive device (1) together with its core and winding, which require only one cable lead connection to the power source arrangement (1), can be of compact, leakproof and chemically resistant design.

17 Claims, 2 Drawing Sheets

DEVICE FOR STIRRING OR PUMPING

BACKGROUND OF THE INVENTION

1. Field of the Invention

The present invention concerns a device for stirring or pumping, wherein a magnetic rotor of suitable configuration is free to rotate in a receptacle or tube and is driven by a rotary electromagnetic field arrangement.

The particles of liquid or gas are put into circular motion by stirring, whereby concentration and temperature differentials can be speedily eliminated. With the aid of the stirring process solids and gases are more quickly dissolved and in extractive processes stirring helps to accelerate the mass-transfer and also has a very important part to play in completing chemical reactions: insufficient stirring can deteriorate product composition and yield and may even result in explosions.

2. Description of the Prior Art

Pumping induces mainly linear directed motion in gases or liquids, which phenomemon is typically made use of in moving the medium from one receptacle to another. In some applications, such as in loop reactors of the type used in chemical processes, for example, pumps are also used to produce the same effects as stirring, whereby the medium is circulated from the output side of the pump and returned to the suction side.

This is the reason why a universal device has been sought which is capable of inducing universal movement in the medium being handled, allowing a number of different functions, such as stirring and pumping to be carried out by the use of rotors of suitable configuration, in conjunction with further functions such as gas absorption, for example. Furthermore, it is important that such movement in the medium be induced in receptacles or vessels of various configurations and/or at various different stages in the course of the process or locations in the apparatus employed in the process; in other words, to achieve universal applicability.

Stirrers in which a permanently magnetic stirrer or paddle device is driven by a rotary magnetic field are in widespread use, principally in chemical laboratories in processes where only small quantities of liquid have to be stirred. With previously known stirrers of this type, the rotary magnetic field has been generated by the rotation of a permanent magnet centrally mounted on the spindle of an electric motor.

In drive systems of the conventional type, the presence of mechanical moving components has an adverse effect on operating reliability, especially in continuous service where operation cannot be supervised at all times. The design of these systems requires that they generally occupy a great deal of room and they are also extremely heavy, which is a further disadvantage if they are to be used in conjunction with fragile and complicated glass apparatus and in applications where space is restricted, as is often the case with optical measurement instruments, for example. The provision of arrangements to govern the speed of the driving motor is complex and expensive, as is the design of leakproof vessels and corrosion resisting stirring devices for use in thermostatically controlled baths. Furthermore, conventional stirring mechanisms can only be arranged in an offset location in a stirring vessel with a centrally arranged outlet. As a result the amount of power which can be applied will be considerably diminished.

Various proposals are known (Swiss patent document No. CH 501 429, for example) for eliminating some of these disadvantages, by arranging for the rotary magnetic field to be generated by fixed electromagnets, for example.

In some of the designs which have been proposed, there is a tendency for the stirring mechanism to run unevenly and to skip, even in cases where the coils are supplied with sinusoidal alternating current instead of a pulse-shaped alternating current. The occurrence of such phenomena lowers the maximum speed and limits maximum rotary torque levels, and also adversely affects operating reliability, especially with the sort of load fluctuations which are encountered when chemical reactions are taking place in the medium.

In another known design (Swiss patent document No. CH 617 360 A5) an attempt is made to eliminate uneven running by fitting a fixed plate of soft magnetic material such as Mumetal, for example, to the intended axis of rotation of the stirring mechanism and in its immediate vicinity. This solution achieves some desirable characteristics at the expense of economy since the soft magnetic plate tends to shield the permanent magnet of the stirring mechanism. In addition, the distance between the soft magnetic plate and the stirring mechanism has to be kept as small as possible to achieve a marked effect, and this design is unsuitable when a medium has to be stirred in a vessel with a central outlet at the bottom.

The effectiveness of previous designs also suffers from the fact that the electromagnets employed are fitted with members, cores or pole pieces arranged close to one another and a large part of the magnetic field lines of force are thus prevented from reaching the desired effective area.

Previous designs therefore suffer from the fact they are only of limited applicability, that they show uneven rotation or that they have a high magnetic loss. In addition they often require a large spatial volume and complex and expensive construction.

SUMMARY OF THE INVENTION

Thus, an object of the present invention is to overcome the disadvantages of previous designs and to provide a universal device for stirring and generally mixing media which can be employed in universal applications, which can be made inexpensively and whose design combines limited space requirements with the provision of a high level of magnetic efficiency. This requirement is met with the present invention by the provision of a device for stirring or pumping a medium together with a power supply system, an electromagnetic drive arrangement and a magnetic rotor which is free to rotate in the medium and which exerts a stirring or pumping action as it revolves, whereby phase-shifted alternating current is provided by the power supply system, thus energizing the electromagnetic drive arrangement which is fitted with an annular core of ferromagnetic material provided with at least two fixed magnetic coil segments wound around the annular core, over which the electromagnetic drive arrangement generates a rotary magnetic field which serves to turn the rotor.

BRIEF DESCRIPTION OF THE INVENTION

Various embodiments of the present invention will be further described with the help of the following drawings, in which.

DESCRIPTION OF PREFERRED EMBODIMENTS

Figure 1:
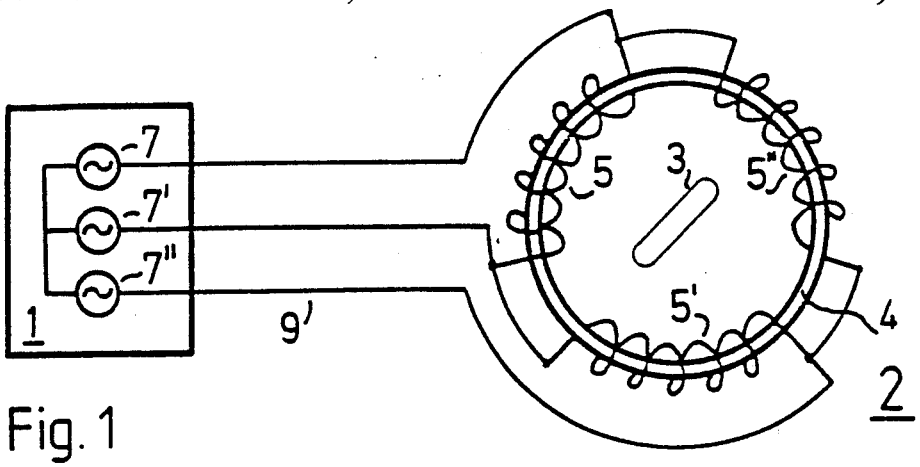
FIGS. 1 and 2 illustrate the operating principle of a first and second embodiment of the present invention.

The embodiment illustrated in FIG. 1 shows a power supply arrangement 1 which provides three alternating currents 7,7'7'' phase-shifted at 120° with respect to one another, supplied via a lead 9 to three magnetic coil segments, 5,5' and 5'' in the electromagnetic drive arrangement 2. These magnetic coil segments are wound around an annular core 4 in a similar way as windings are wound around ring cores. When the coil segments are energized by the phase-shifted alternating currents, a rotary magnetic field is generated in the vicinity of the axis of the annular core, which initiates rotation of a magnetic rotor 3 which can rotate freely and which in this instance takes the form of a permanently magnetized stirring agitator. Soft magnetic annular cores are products known to the art and may be used in conjunction with a different winding circuit or circuits, in throttles, transmitters and transformers with low stray field intensity levels.

Figure 2:
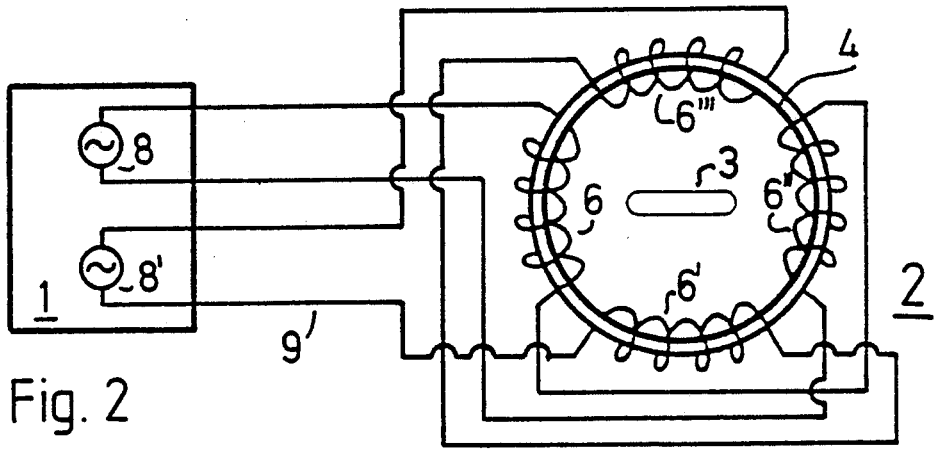

FIG. 2 is a schematic view of an especially simple and efficient embodiment of the present invention with four magnetic coil segments 6,6',6'',6''' which are controlled by only two phase-shifted alternating currents 8, 8'' shifted about 90° with respect to one another. As in the case of the first embodiment shown in FIG. 1, the annular core is not provided with individual ferromagnetic poles. The four windings are arranged as symmetrically as possible about the core 4 and a core material with soft magnetic properties is used, whose permeability is as free from the influence of the field strength as pbssible. Under the influence of sinusoidal alternating currents phase-shifted at 90° to one another, this arrangement provides an extremely regular rotary magnetic field. Since the stirring agitator or rotor 3 adjacent to the axis of the annular core cannot stick at individual ferromagnetic poles, its rotary motion will also be smooth and regular. Smooth rotary travel is most essential for the transmission of optimal stirring effort and high maximum speeds.

Figure 3:
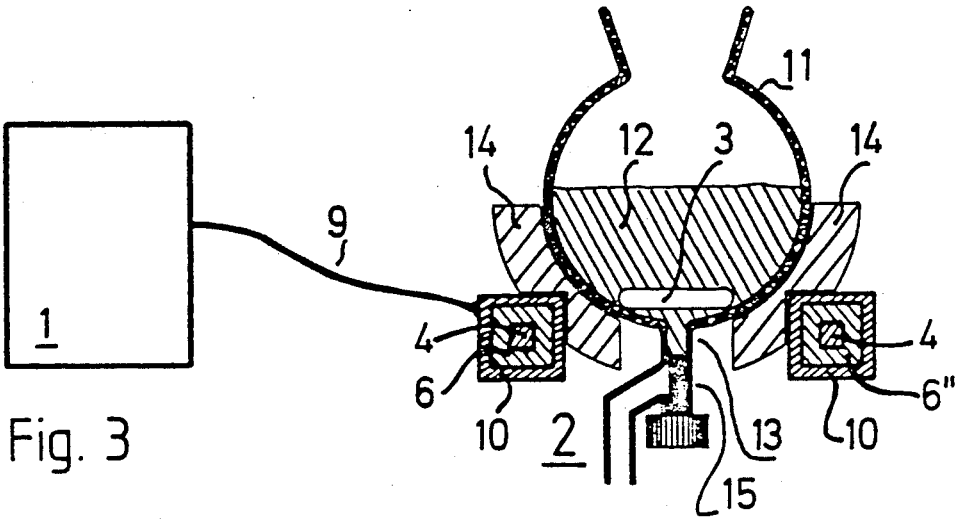
FIG. 3 shows the cross section of a wound core together with a vessel with an outlet in the bottom.

FIG. 3 shows a cross section of the wound core of the second embodiment in this case, where the stirring agitator or rotor 3 is in contact with the liquid or medium 12 contained in a vessel 11. The bottom of this vessel may also be provided with a central outlet which may be closed with a cock 15, for example. Vessels of this type are in widespread use in laboratories. The power supply arrangement 1 which is the source of the alternating current is connected to the core windings by a lead 9 comprising a multistrand cable. The windings of the magnetic coil segments 6, 6',6'' and 6''' around the core 4 are impregnated and coated with a suitable plastic mass 10 such as an epoxy resin. In this way, this part of the equipment is suitable for use in a water bath, for example. Depending on the medium and the application concerned, various types of coatings, protection or sheathing may be employed as an anti-corrosive barrier to ensure troublefree operation.

Figure 4:
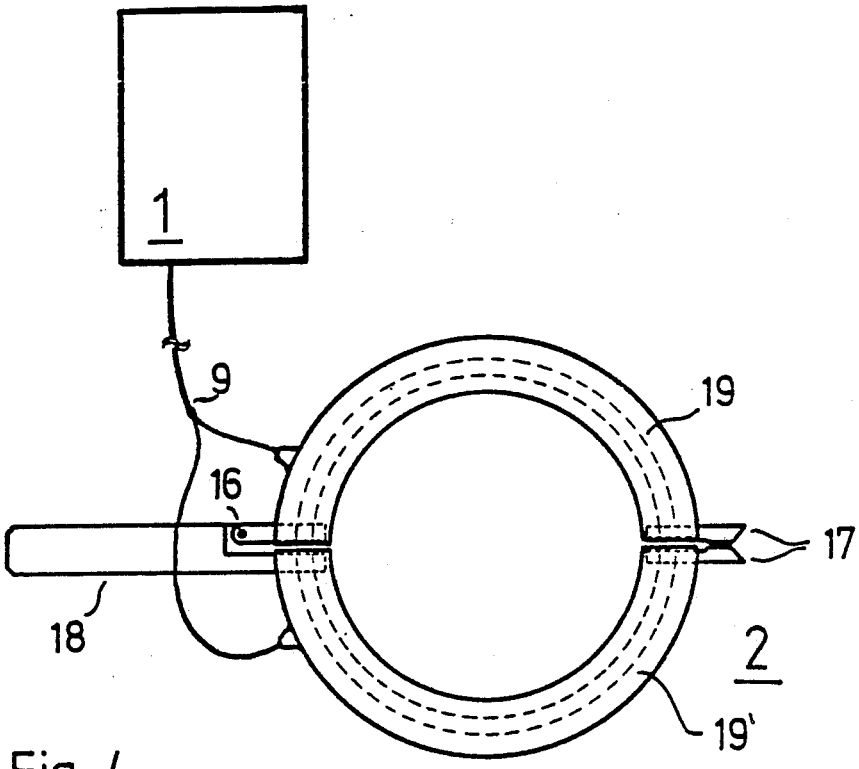
FIG. 4 shows a third embodiment of an electromagnetic drive arrangement which can be opened up.

FIG. 4 shows a further embodiment of the present invention where the electromagnetic drive arrangement 2 comprises two parts 19 and 19', which can be swung open around a hinge 16 mounted on a bracket 18. The fact that the drive arrangement can be opened up facilitates installation in many instances. In FIG. 4 the ring is shown closed ready for operation, whereby both halves of the annulus are kept closed by a retaining arrangement 17, which may consist of two magnetic clamps or a latch, for example. The core and the winding are impregnated and coated against corrosion in this case as well and are connected to the power supply 1 by means of the lead 9.

Figure 5:
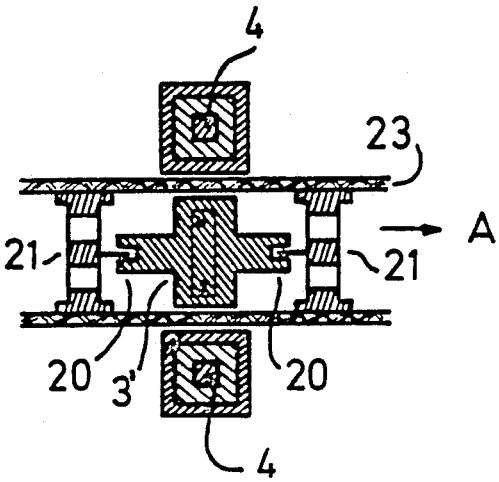
FIG. 5 shows the longitudinal section of a further embodiment of the present invention in the form of a pump.

FIG. 5 shows the longitudinal section of a further embodiment of the present invention in the form of a pump. In this case, the wound and coated core 4 encompasses a tube 23 through which the medium passes in the direction indicated by the arrow A. The blades of a specially configured magnetic rotor 3' located inside the tube develop a pumping effect as the rotor revolves. At the same time, two bearing elements 20 of the rotor are accommodated by the bearing retainers 21. The bearing retainers are fixed inside the tube by means of the clamping elements 22.

Figure 6:
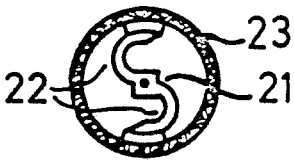
FIG. 6 shows a variant of the bearing retention arrangement used in the embodiment shown in FIG. 5.

The present invention can also be usefully employed to step up the rate of material transfer in liquid or gas absorption or extraction processes. For the purpose of such applications, the magnetic rotor is specially configured as a gas absorption or extraction device preferably revolving about a vertical axis and driven by a rotary magnetic field according to the present invention. In this case, the rotor may be supported on one or two bearing supports of the type illustrated in FIGS. 5 or 6.

The two 90° phase-shifted alternating voltages provided by the power supply arrangement for the control of the annular core with its four windings may, for example, by synthesized by an integrated functional generator of a type known to the art in conjunction with other electronic components. The functional generator's sinusoidal output gives the signal for one of the two phases. A 90° phase-shifted triangular voltage is generated from the functional generator's triangular output with four analog processing circuits and a quadruple analog multiplexer. This signal is then converted with an appropriate triangular-sinusoidal-converter to be used as the second phase. The alternating voltages may also be generated by digital means and transformed into an analog signal by means of a DA converter.

On start-up it will frequently be necessary for the speed at the power source to be gradually increased to the required level for the rotor not to get out of phase. In a fifth embodiment of the present invention, this starting procedure will be initiated automatically by activating a switch. The corresponding electric circuit can be extremely simple if a voltage-controlled oscillator is used as the element providing the frequency. The mean rate of frequency rise can then be selected as a parameter of a variable resistance, for example, by means of which a condenser is charged. If the signal is generated by digital means, the software for the automatic start-up arrangement can be realized by means of a program for the control of the power supply current, thus providing a means of controlling rotor operation. A frequent requirement in stirring processes is for the rotor device to be able to reverse direction after a certain period of operation or merely act in an agitating function. Embodiments of the present invention incorporating this feature can also be easily realized.

In a further useful embodiment of the present invention, the drive arrangement 2 may be furthermore combined with a heating or cooling device. In FIG. 3, the annular wound core is fitted inside a heating mantle 14 in an embodiment of the invention which is mainly suitable for distilling processes or for the performance of chemical reactions in round-bottom flasks.

The claimed scope of the present invention is not limited to the embodiments described here. For example, practical and useful devices can be also realized using other phase shifts than those referred to here or with different curve configurations or arrangements of the coils on the annular core. The coil segments shown in FIGS. 1 and 2 are intended to show schematic representations and are not meant to be interpreted as determining the number of windings per coil segment. The number of windings employed for each magnetic coil will be a function of the required magnetic flux and the intensity of the power supply source. The annular ferromagnetic core may be made of solid or of segmented material to diminish eddy currents. The core may be made of segmented elements to achieve savings in production costs.

An arrangment of fixed magnet coils has been proposed previously (Swiss Patent document No. CH 612 855 A5), by means of which a medium could be stirred, for example, in a vessel with a central outlet in the bottom. In this device, individual coils were arranged together with their cores disposed radially inside an annulus. In this arrangement, the annulus served only as a magnetic yoke and not as a core for the coils. The essential advantage provided by the present invention lies in the use of an annular core which eliminates the requirement of individual ferromagnetic poles. Although the presence of individual ferromagnetic poles generally exerts a negative effect and is therefore undesirable, their use in particular cases where they might be needed, is not excluded in the present invention.

The features of the present invention disclosed in the above description, in the drawings and in the claims are characteristics which may, either individually or in suitable combinations, constitute an essential part of the realization of this invention, in its various embodiments.

I claim:

1. A device for inducing motion in a fluid medium within a vessel comprising: a power supply means (1) for generating phase-shifted alternating current, an electromagnetic drive means (2) electrically connected to said power supply means (1), and a magnetic rotor (3) free to rotate in said medium when it is at least partially submerged, said rotor inducing said motion in said fluid medium as it rotates, wherein said electromagnetic drive means (2) comprises a core (4) of ferromagnetic material in an annular configuration with respect to the vessel, said annular core (4) having no discrete ferromagnetic poles, and at least two stationary magnetic coil segments (5,5',5'') wound around said annular core, and said at least two stationary magnetic coils (5,5',5'') are energized by said phase-shifted alternating current to generate a rotary magnetic field for rotating said rotor (3).

2. A device for inducing fluid motion according to claim 1, wherein said power supply means (1) generates at least two phase-shifted alternating currents.

3. A device for inducing fluid motion according to claim 1, wherein said electromagnetic drive means (2) comprises four said magnetic coil segments (6,6',6'',6''') arranged essentially symmetrically around said annular core, and said magnetic coil segments are energized by two phase-shifted alternating currents (8,8') whereby adjacent coil segments are operated by phase-shifted alternating currents.

4. A device for inducing fluid motion according to claim 1, wherein said electromagnetic drive means (2) comprises at least two core parts (19,19') which are hinged and in a closed position form said annular core, whereby each said core part comprises a whole number of magnetic coil segments.

5. A device for inducing fluid motion according to claim 1, wherein said electromagnetic drive means (2) additionally comprises a protective coating, whereby said electromagnetic drive means (2) may be at least partially submerged and is operable in said fluid medium.

6. A device for inducing fluid motion according to claim 1, wherein said power supply means comprises a programmable current supply sequence means allowing variation of said phase-shifted alternating current to provide variation of at least one of the frequency, amplitude and direction of rotation of said magnetic rotor (3).

7. A device for inducing fluid motion according to claim 1, additionally comprising a bearing (20,21) provided on at least one side of said rotor (3'), and resilient clamping elements (22) for retaining said bearing in a predetermined position inside the vessel.

8. A device for inducing fluid motion according to claim 1, wherein said electromagnetic drive means (2) additionally comprises a temperature control means (14).

9. A device for inducing fluid motion according to claim 8, wherein said temperature control means (14) is a heating means.

10. A device for inducing fluid motion according to claim 8, wherein said temperature control means (14) is a cooling means.

11. A device for inducing fluid motion according to claim 1 having two said fixed magnetic coil segments (19,19') each supplied with 180° phase-shifted alternating current.

12. A device for inducing fluid motion according to claim 1 having three said fixed magnetic coil segments (5,5'5'') each supplied with 120° phase-shifted alternating current.

13. A device for inducing fluid motion according to claim 1 having four said fixed magnetic coil segments (6,6',6'',6''') each supplied with 90° phase-shifted alternating current.

14. A device for inducing fluid motion according to claim 1 wherein said medium is liquid.

15. A device according to claim 14 wherein said magnetic rotor functions as a stirrer.

16. A device according to claim 14 wherein said magnetic rotor functions as a pump.

17. A device for inducing fluid motion according to claim 1, wherein said electromagnetic drive means (2) comprises at least two parts (19,19') which are hinged and can be separated from one another, whereby each said part comprises only whole magnetic coil segments.

* * * * *